United States Patent [19]

Kaufman

[11] Patent Number: 4,978,308

[45] Date of Patent: Dec. 18, 1990

[54] SURFACE MOUNT PIN HEADER

[75] Inventor: John W. Kaufman, Hershey, Pa.

[73] Assignee: AMP Incorporated, Harrisburg, Pa.

[21] Appl. No.: 452,523

[22] Filed: Dec. 18, 1989

[51] Int. Cl.[5] ..... H01R 9/09

[52] U.S. Cl. ..... 439/83; 439/78; 439/81

[58] Field of Search ..... 439/60, 65, 76, 78–83, 439/598, 701, 712, 733, 751, 869, 870, 876

[56] References Cited

U.S. PATENT DOCUMENTS

| | | | |
|---|---|---|---|
| 4,682,829 | 7/1987 | Kunkle et al. | 439/83 |
| 4,828,503 | 3/1989 | Gilissen et al. | 439/82 |
| 4,867,690 | 8/1989 | Thumma | 439/79 |
| 4,871,320 | 8/1989 | Mouissie | 439/78 |
| 4,895,521 | 1/1990 | Grabbe | 439/78 |
| 4,898,539 | 2/1990 | Glover et al. | 439/81 |

*Primary Examiner*—Paula A. Bradley

*Attorney, Agent, or Firm*—Allan B. Osborne

[57] ABSTRACT

A pin header (10) for being surface mounted on a back panel is disclosed. More particularly the pin header (10) includes contact elements (18,110) having outwardly facing contact surfaces (46,138) on spring arms for engaging circuits on a back panel. The contact elements (18,110) are positioned in dielectric inserts (22,148) which are positioned in a shell (20) and further include pins (24,142) for electrically engaging a receptacle connector.

18 Claims, 7 Drawing Sheets

SURFACE MOUNT PIN HEADER

FIELD OF THE INVENTION

The present invention relates to a pin header of a two piece connector system for surface mounting on a back panel and for receiving the receptacle.

BACKGROUND OF THE INVENTION

Pin headers of two piece connector systems having contact elements with posts for inserting into holes in a back panel are well known in the art as exemplified by U S. Pat. No. 4,867,690. As shown therein, the pins are staked into a molded housing with pins extending into a outwardly open cavity and posts extending outwardly from a base surface for insertion into holes in the back panel. The advantage of these type headers is their use on multi-layer panels. However, a disadvantage is that plated through holes and multi-layered panels are not always required and in some uses, may be a disadvantage.

Accordingly, it is now proposed to provide a pin header having contact elements which are surface mountable to circuits on a back panel.

SUMMARY OF THE INVENTION

According to the invention a pin header is provided which includes a housing and contact elements in the housing which include generally C-shaped spring arms having outwardly facing contact surfaces for electrically engaging circuits on a back panel.

DESCRIPTION OF THE INVENTION

Figure 1:
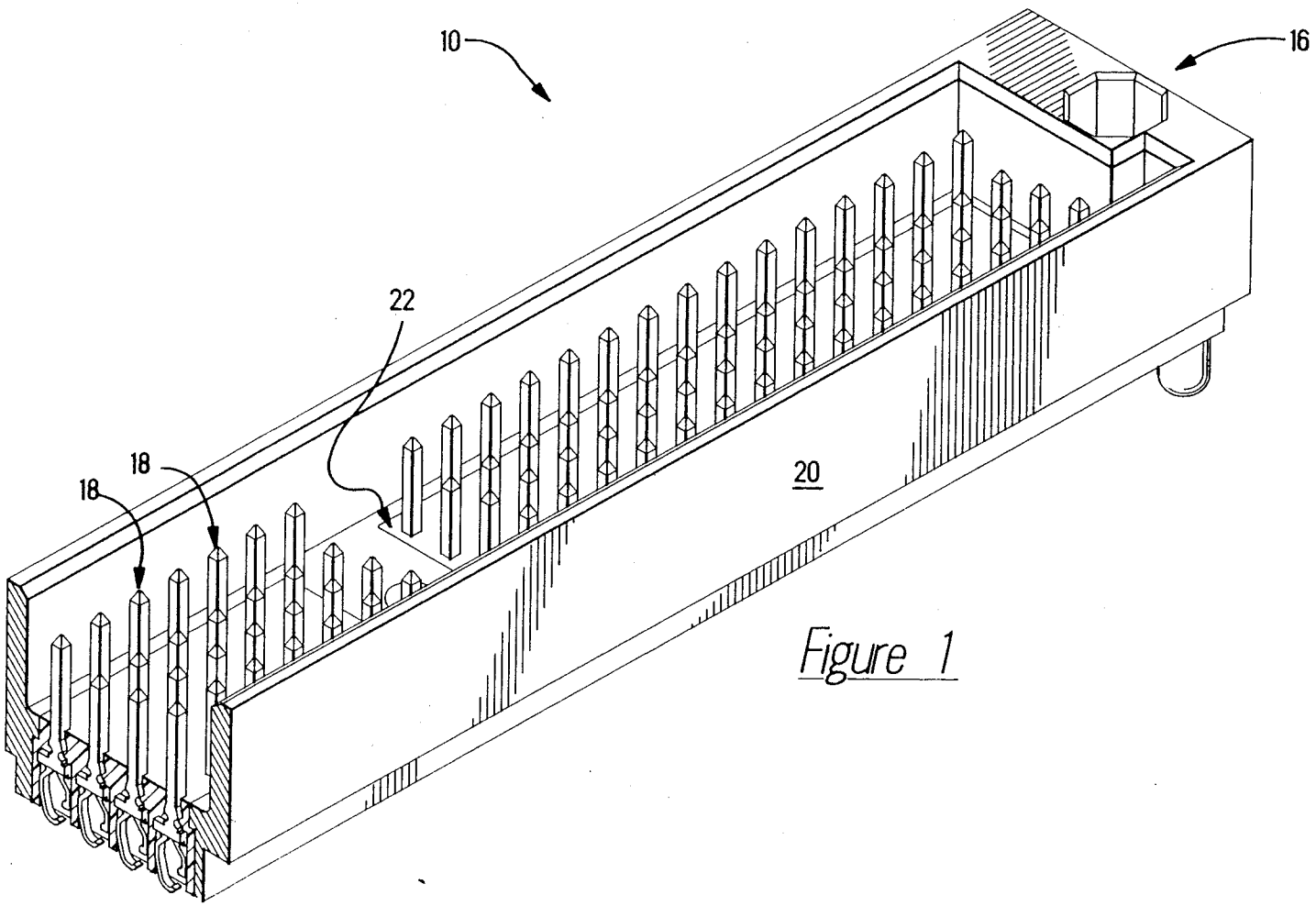
FIG. 1 is a perspective, sectioned view of a pin header constructed in accordance with the present invention.
Figure 5:
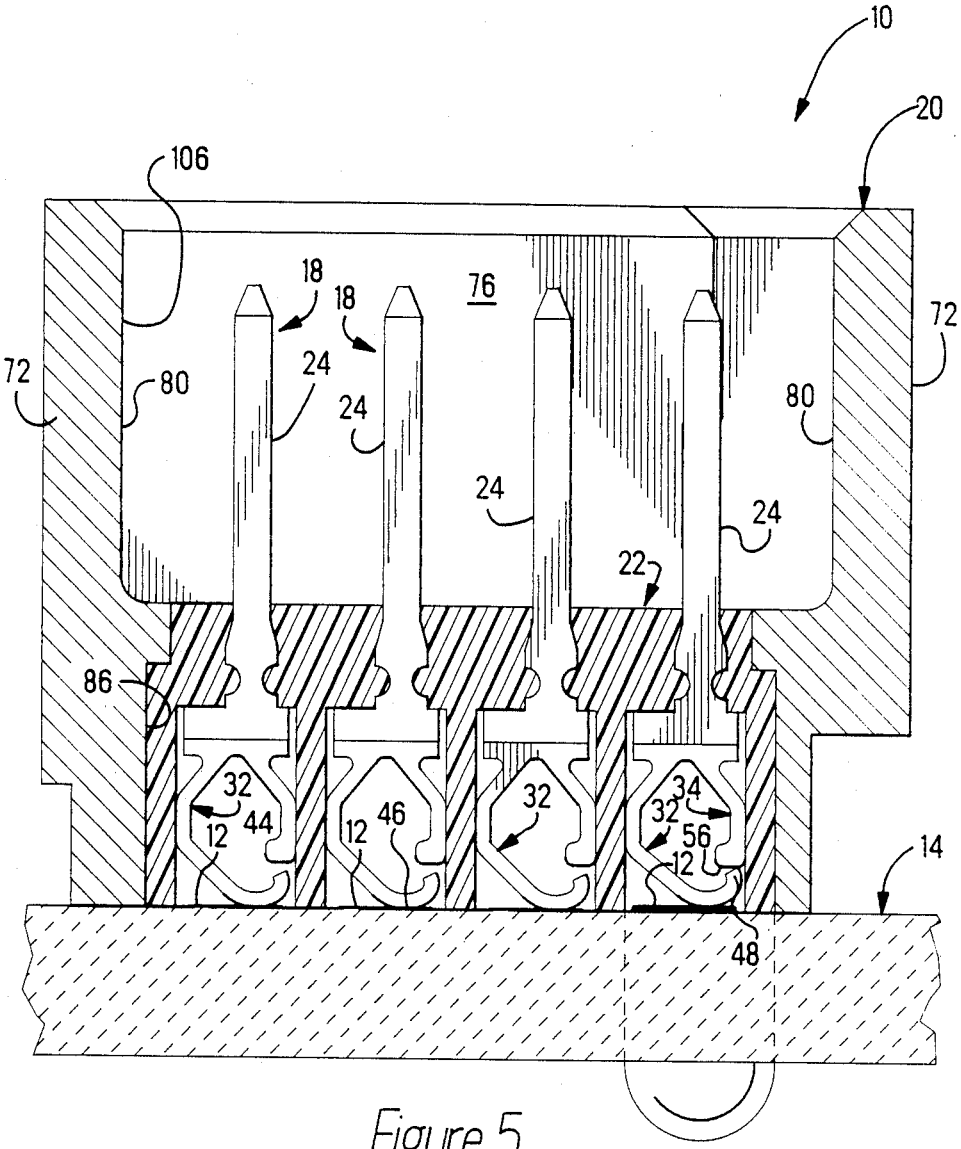
FIG. 5 is a sectioned end view of the pin headed mounted on a back panel.

Pin header 10 shown in FIG. 1 is one of a two piece connector system used to electrically interconnect a daughter card (not shown) to circuits 12 on back panel 14 (FIG. 5). The aforementioned U.S. Pat. No. 4,867,690 discloses such a system.

Header 10 includes housing 16 and a plurality of contact elements 18. As will be more fully described below, housing 16 comprises shell 20 and inserts 22.

Figure 2:
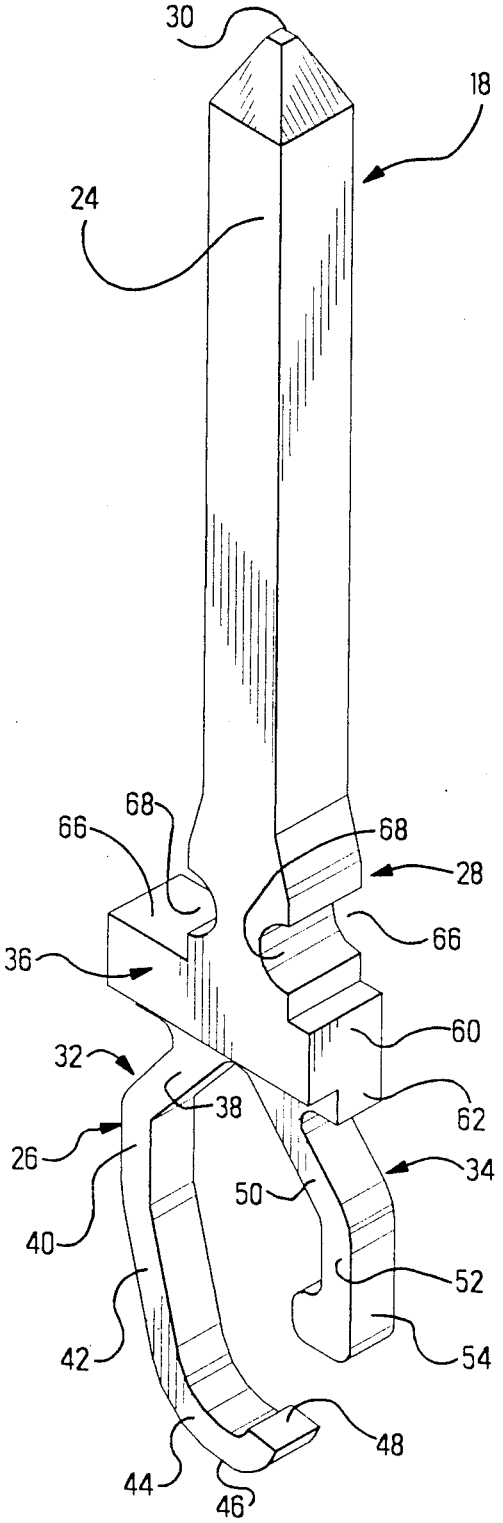
FIG. 2 is a perspective view of a contact element constructed in accordance with the present invention.

Contact elements 18 are preferably stamped and formed from a suitable conductive material as beryllium-copper or phosphor bronze. As shown in FIG. 2, an element 18 includes pin 24 at one end, a surface mountable termination section 26 at another end and retention section 28 in between.

Pin 24 is generally square in cross-section but could have other configurations. A beveled free end or tip 30 facilitates pin 24 being received in a receptacle (not shown).

Termination section 26 includes spring arm 32 and stabilizer arm 34. Both arms 32 and 34 are attached to and extend outwardly from an L-shaped base member 36.

Arm 32 is a composite of a first portion 38 which projects obliquely outwardly from base 36, a second portion 40 which is parallel to the longitudinal axis of element 18, a third portion 42 which projects obliquely inwardly and hook portion 44 which curves back in towards base 36 so that a convex contact surface 46 faces outwardly. Free end 48 of hook portion 44 is shown as being flat but it could be spherical if desired.

Stabilizer arm 34 includes a first portion 50 which projects obliquely outwardly from base 36 in an opposite direction relative to first portion 38 on arm 32. Attached to first portion 50 is a second portion 52 which is parallel to the longitudinal axis of element 18 and also to second portion 40 on arm 32. At the free end of arm 34 is an enlarged third portion 54 with a outwardly facing flat surface 56.

Base member 36 of section 26 includes a first portion 60 which is of the same thickness as pin 24 and retention section 28 and a thinner second portion 62. The thinner material of portion 62 is reflected in arms 32 and 34 to provide more flexibility thereto.

Retention section 28 includes, on two opposite sides, cut outs 66 defined by concave surfaces 68.

Figure 4:
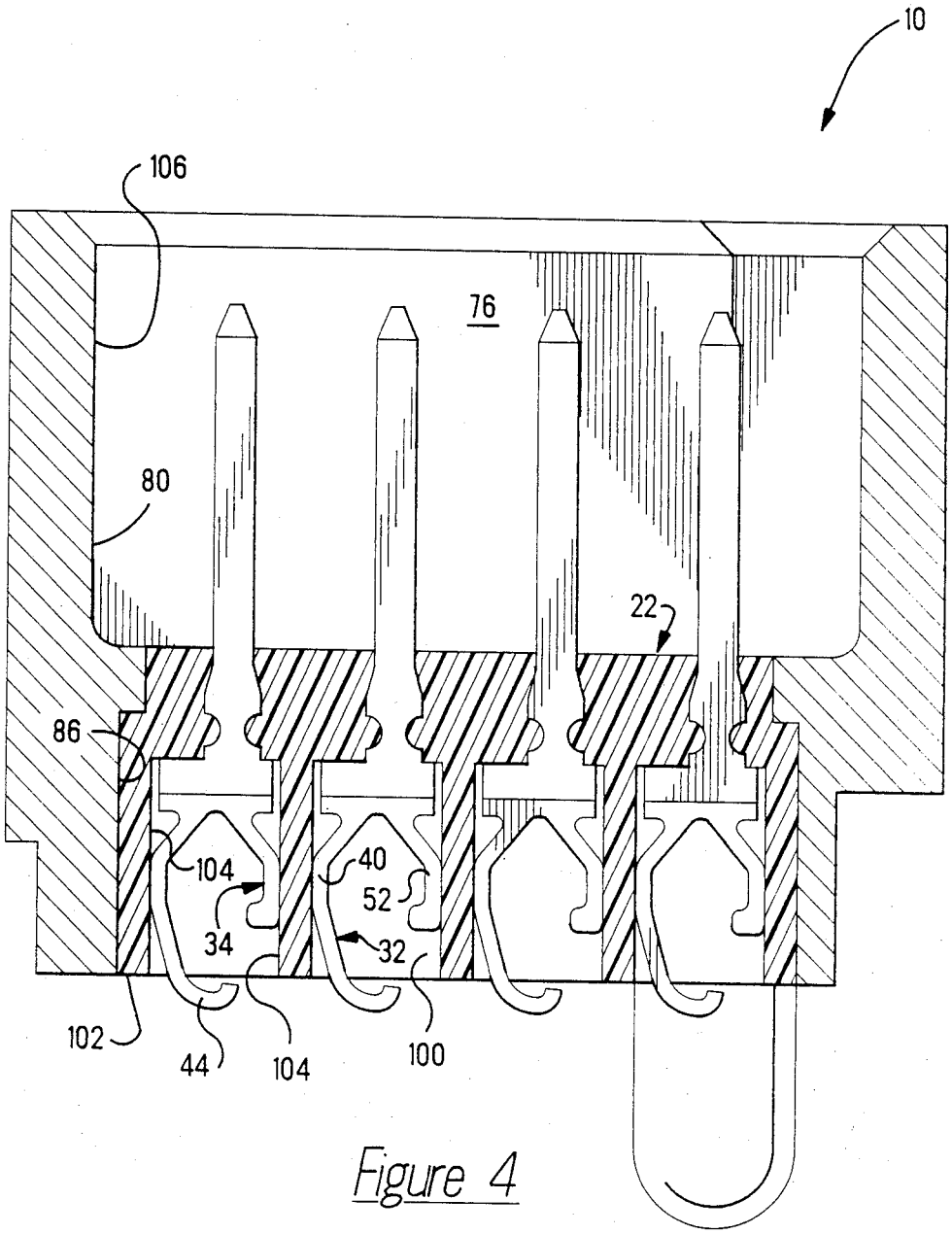
FIG. 4 is a sectional end view of the pin header of FIG. 1.

As is more noticeable in FIGS. 4 and 5, pin 24 and retention section 28 are offset to one side relative to termination section 26. This has been done to position pins 24 equally across the width of housing 16.

Figure 3:
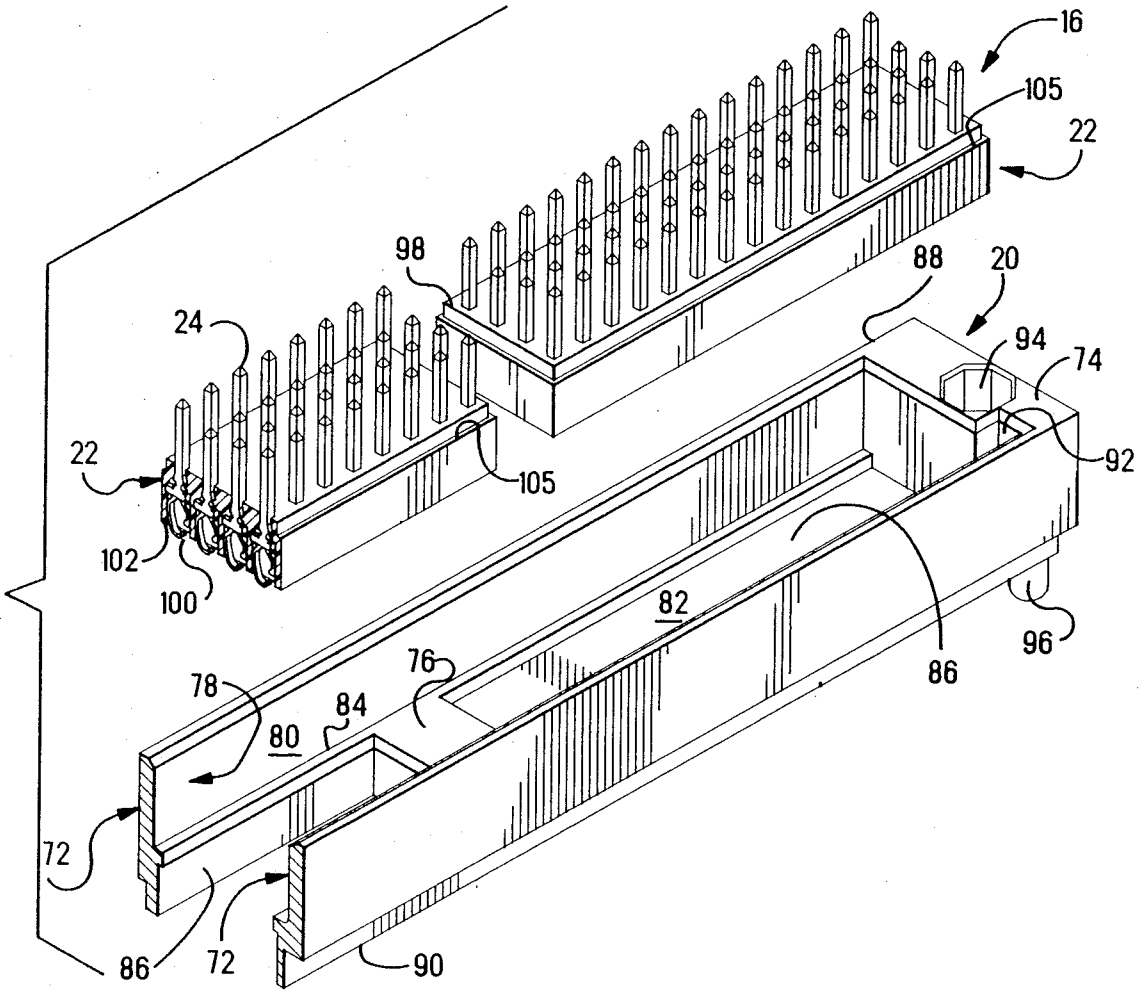
FIG. 3 is the same view as FIG. 1 but with the inserts removed from the housing shell.

As shown in FIG. 3, housing 16 includes shell 20 and inserts 22. Shell 20 is defined by parallel side walls 72, end walls 74 (only one shown) and transverse walls 76. The inside surface 78 of side walls 72 are divided into an upper surface 80 and lower surface 82 by longitudinally extending, inwardly projecting rails 84. Transverse walls 76 extend between and are attached to opposite lower surfaces 82 and are provided at spaced intervals longitudinally to define cavities 86 in cooperation with other transverse walls 76 or end walls 74. Cavities 86 open outwardly through the top surface 88 and bottom surface 90 of housing shell 20.

End walls 74 include a polarizing slot 92, keyway 94 and projecting from bottom surface 90, a locating stud 96.

Shell 20 as illustrated is made from a metal such as zinc or aluminum. However, other suitable materials may be used.

Inserts 22 are molded with the preferred dielectric material being polyester. Molding is done with contact elements 18 positioned in the mold (insert molding) with the mold material filling cut outs 66 to lock elements 18 in place. Pins 24 extend above top surface 98 of insert 22 and termination section 26 is located in an aperture 100 which opens out on bottom surface 102. As shown more clearly in FIG. 4, hook portion 44 of sparing arm 32 projects below bottom surface 102 and the respective second portions 40,52 on arms 32,34 respectively abut side walls 104 of apertures 100. Inserts 22 are molded to include notches 105 on each side of top surface 98.

Inserts 22 are sized to be frictionally received in respective cavities 86 as shown in FIGS. 1 and 4 to form pin header 10. Rails 84 are received in notches 105.

With reference to FIG. 4, inserts 22 are positioned in shells 20 with pins 24 extending into a receptacle-receiving cavity 106 defined by upper surfaces 80 of side walls 72, end walls 74, transverse walls 76 and inserts 22.

FIG. 5 shows pin header 10 mounted on panel 14 with convex surfaces 46 of contact elements 18 in electrical engagement with circuits 12 thereon. As header 10 is being secured to panel 14; e.g., by bolts or screws (not shown) extending up through panel 14, spring arms 32 are resiliently deformed into apertures 100. In the event of out of tolerances build-up, e.g. a thick circuit 12, free end 48 of arm 32 will abut surface 56 on stabilizer arm 34 to prevent over-stressing. The right hand element 18 illustrates this condition. The compression of spring arms 32 provides an effective normal force against circuits 12 for the desired electrical continuity therebetween.

Figure 6:
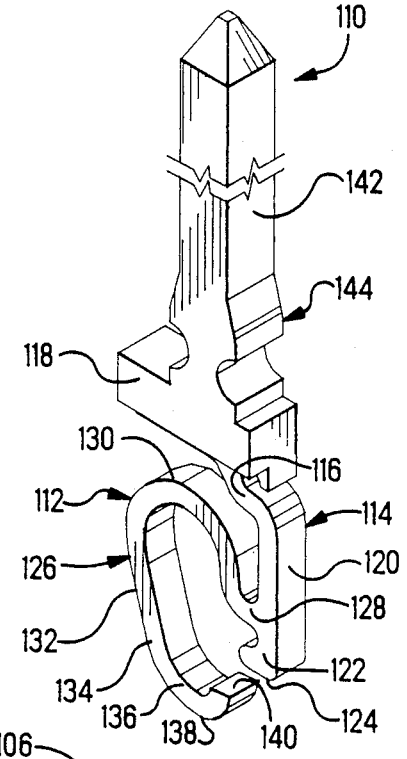
FIG. 6 is a perspective view of another embodiment of a connect element of the present invention.
Figure 7:
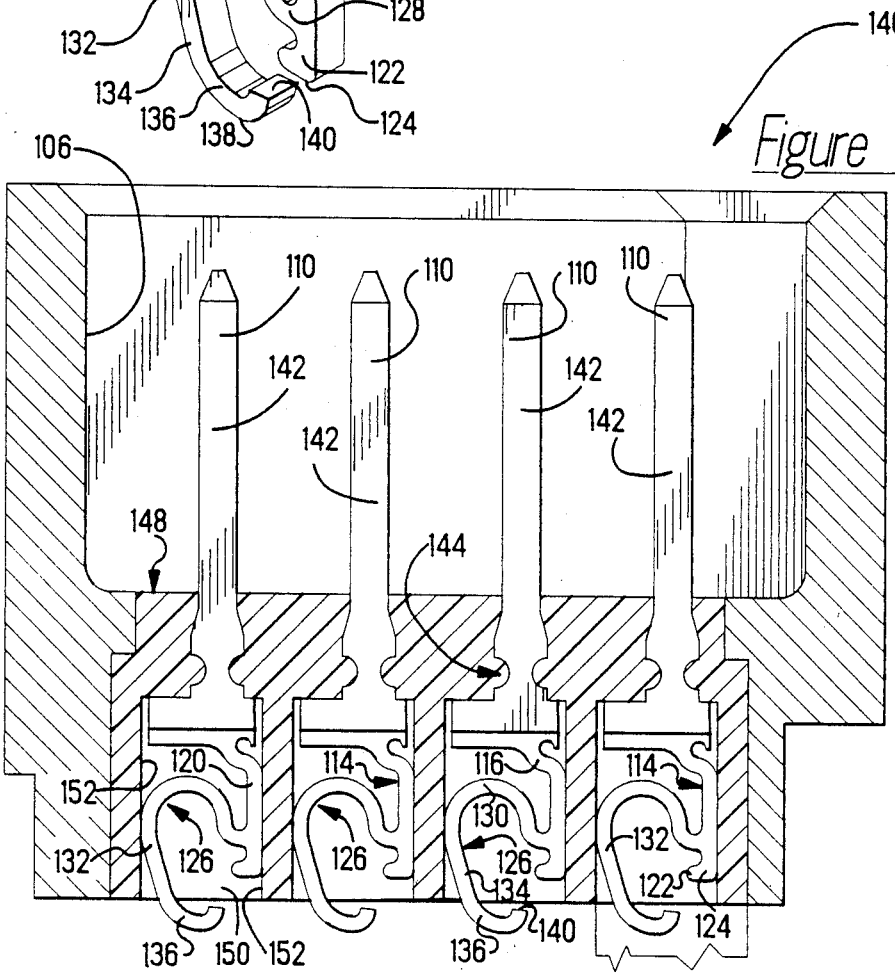
FIG. 7 is a sectional end view of a pin header with the contact element of FIG. 6 utilized therein.
Figure 8:
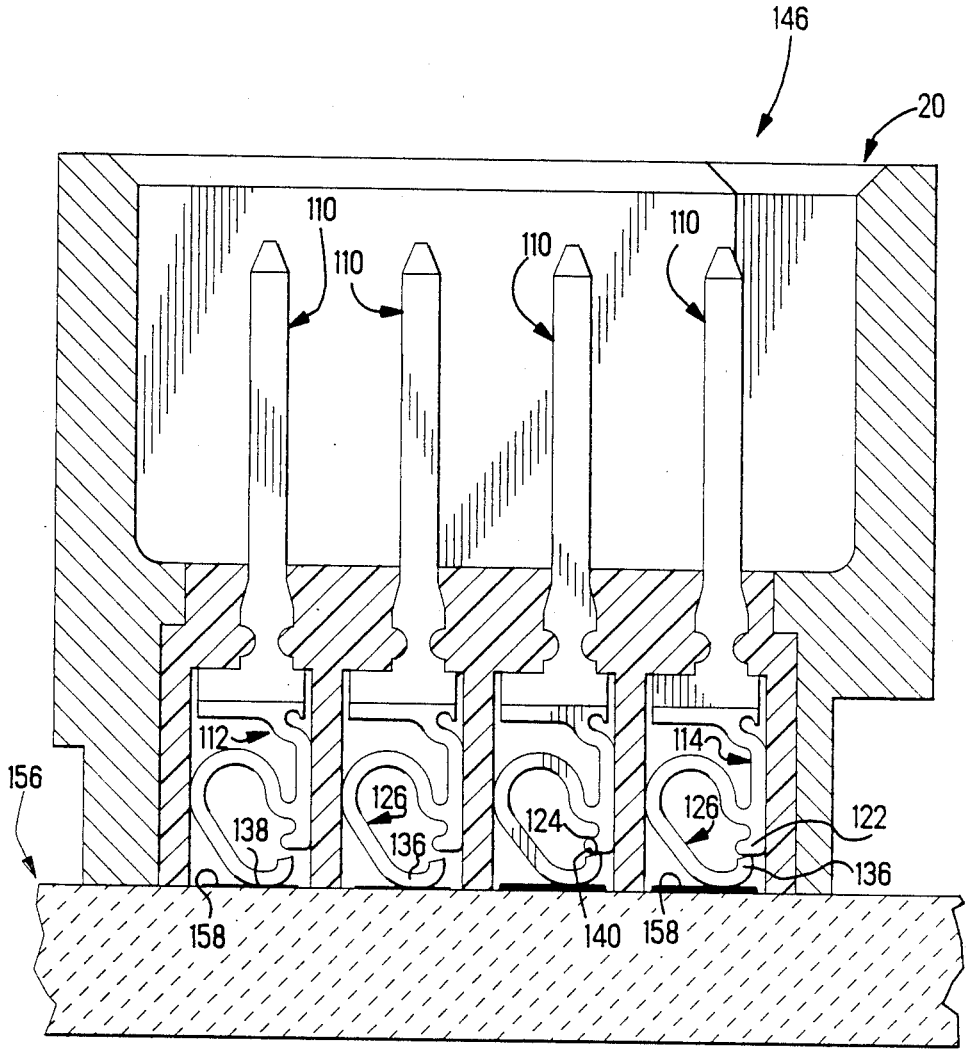
FIG. 8 is a sectioned end view of the pin header of FIG. 7 mounted on a back panel.

FIGS. 6, 7 and 8 show contact element 110 which has a different termination section, indicated by reference numeral 112, that does contact element 18. With respect to termination section 112, a stabilizer arm 114 includes a first portion 116 which projects obliquely outwardly from base 118. A second portion 120, attached to first portion 116, is parallel to the longitudinal axis of element 110 and terminates in an enlarged third portion 122 having an outwardly facing surface 124. A generally C-shaped spring arm 126 is attached to second portion 120 by strap 128. The first portion 130 of arm 126 is curved and describes an arc of about 180° degrees. The second portion 132 is short and is parallel to the longitudinal axis of element 110 and to second portion 120 of base arm 114. Third portion 134 extends obliquely inwardly from second portion 132 and attaches to a hooked fourth portion 136 which is curved to provide an outwardly facing convex contact surface 138. Free end 140 of the fourth portion 136 is flat but may be spherical or pointed.

Base 118, pin 142 and retention section 144 are the same structurally as base 36, pin 24 and retention section 28 on contact element 18.

Pin header 146 shown in FIG. 7 uses the same housing shell 20 as pin header 10. Inserts 148 are of the same material as inserts 22 and include apertures 150. Contact elements 110 are molded into inserts 148 by insert molding procedures well known in the art. The hooked fourth portion 136 of spring arm 126 project outwardly from apertures 150. Parallel second portions 120 of stabilizer arm 114 and 132 of spring arm 126 abut opposing walls 152 of apertures 150.

FIG. 8 shows pin header 146 mounted on back panel 156 with convex contact surfaces 138 engaging circuits 158. As header 146 becomes secured to panel 156, spring arms 126 are resiliently compressed into apertures 150 to generate the normal force against circuits 158. As indicated in the two elements 110 on the right hand side, over-stressing of spring arm 126 is prevented by free end 140 abutting outwardly facing surface 124.

It has been noted above that contact elements 18 and 110 are insert molded into respecting inserts 22,148. However the respective retention sections 28,144 and inserts 22,148 may be redesigned so that elements 18,110 would be loaded into inserts 22,148 respectively after molding.

Pin header 10 and 146 illustrate one particularly significant advantage in that shall 20 can be loaded with inserts having contact elements 18 or 110 on different spacings and different densities as required.

An advantage of metal shell 20 is that it can be grounded to a grounding circuit (not shown) on the back panel to provide shielding.

An advantage gained by the use of surface mount contact elements 18,110 in a two piece connector system is the elimination of plated through holes in the back panel and thereby the number of layers in the panel.

As can be discerned from the foregoing, a pin header for a two piece connector system has been disclosed in which the contact elements are surface mounted on a back panel. The pin header includes a housing comprising a shell with a plurality of cavities to receive inserts carrying the surface mount contact elements. The contact elements include a curved spring arm having a outwardly facing contact surface for engaging circuits on the panel. As the pin header is being secured to the panel, the spring arms are resiliently compressed to obtain a normal force against the circuits on the back panel.

I claim:

1. A pin header for use in a two piece connector system, said pin header comprising:

a housing shell having a plurality of cavities defined by side walls, end walls and transverse walls spaced along the length of said shell and extending between and attached to said side walls;

a plurality of inserts disposed in respective cavities; and a plurality of contact elements retained in said inserts, said elements having at one end a post extending outwardly from one surface of said inserts, a resilient spring arm and another arm, said spring arm extending outwardly from an aperture in said insert and having a contact surface facing outwardly from an opposite surface of said inserts and compressible thereinto, said contact surface being adapted to electrically engage a circuit on a substrate on which the pin header may be mounted, further said spring arm and said another arm having portions thereon which abut walls defining said aperture.

2. The pin header according to claim 1 wherein said spring arm is generally C-shaped and with said contact surface being adjacent a free end of said arm.

3. The pin header according to claim 1 wherein said spring arm is attached to said another arm.

4. A pin header for being surface mounted on a substrate comprising:

a housing shell having a plurality of cavities opening onto opposite surfaces;

a plurality of inserts disposed in said cavities; and a plurality of contact elements disposed in said inserts, said elements having a termination section at one end with said termination section including a spring arm with a convex contact surface facing outwardly from a surface of said inserts for being pressed against circuits on a substrate on which the pin header may be mounted, further said terminal section includes a stabilizer arm.

5. The pin header of claim 4 wherein said spring arm is generally C-shaped and with a free end thereon facing a free end on said stabilizer arm.

6. The pin header of claim 4 wherein both spring arm and stabilizer arm include parallel portions thereon which are parallel to the longitudinal axis of said contact element and to each other.

7. The pin header of claim 6 wherein said inserts include outwardly open apertures which receive said termination sections and said parallel portions on said arms abut opposing walls defining said apertures.

8. The pin header of claim 4 wherein said spring arms and said stabilizer arms extend outwardly from a base means on said contact element.

9. The pin header of claim 8 wherein said spring arm is resiliently compressible.

10. The pin header of claim 9 wherein said free ends on said spring and stabilizer arms cooperate to provide stop means to prevent said spring arm from being overstressed.

11. A pin header for being mounted on a substrate and for use in a two piece connector system, said pin header comprising:

housing means; and a plurality of contact elements disposed in said housing means, said contact elements having pins at one end for being received in receptacle terminals in another connector in the two piece connector system and a termination section at another end, said termination section including a generally C-shaped spring arm with an outwardly facing contact surface for engaging a circuit on the substrate on which the pin header may be mounted, said termination section further having stop means for preventing said spring arm from being overstressed and a stabilizer arm with said spring arm being attached thereto.

12. The pin header of claim 14 wherein said stop means include facing free ends on said spring arm and said stabilizer arm which may abut each other upon compressing said spring arm.

13. The pin header of claim 11 wherein said pins are displaced laterally relative to said spring arm.

14. The pin header of claim 11 with said spring arms being thinner relative to said pins.

15. The pin header of claim 11 wherein said termination section further includes a base.

16. The pin header of claim 15 wherein said termination section further includes a stabilizer arm.

17. The pin header of claim 16 wherein said spring arm and said stabilizer arm extend outwardly from said base.

18. The pin header of claim 16 wherein said stabilizer arm extends outwardly from said base and with said spring arm attached to said stabilizer arm.

* * * * *